United States Patent [19]

Smith

[11] Patent Number: 4,953,602

[45] Date of Patent: Sep. 4, 1990

[54] APPARATUS AND ASSOCIATED METHODS FOR FORMING CURVED WOODEN HAND RAILS FOR SPIRAL STAIRCASES AND THE LIKE

[76] Inventor: Lynn H. Smith, Rt. 1 - Box 110, Gunter, Tex. 75058

[21] Appl. No.: 447,626

[22] Filed: Dec. 8, 1989

[51] Int. Cl.[5] ..... B27D 1/00; B27H 1/00

[52] U.S. Cl. ..... 144/349; 144/269; 144/352; 156/228; 269/43; 269/270

[58] Field of Search ..... 144/269, 270, 349, 352, 144/256.1; 156/60, 228; 269/43, 44, 249, 265, 266, 268, 270

[56] References Cited

U.S. PATENT DOCUMENTS 124,108 2/1872 Andereson ..... 269/270 X

FOREIGN PATENT DOCUMENTS 1728013 11/1975 Fed. Rep. of Germany ..... 144/349

*Primary Examiner*—W. Donald Bray

*Attorney, Agent, or Firm*—Hubbard, Thurman, Turner, Tucker & Harris

[57] ABSTRACT

The construction and installation of a curved, laminated wooden bending rail used as a hand rail on a spiral staircase or the like is significantly facilitated utilizing a series of contoured clamp structures which circumscribe the rail and uniformly engage it, at each clamp location, around its entire periphery. Each clamp structure includes a pair of bolt-connected clamping blocks which may be drawn into circumbscribing abutment with and tightened around the rail. When the clamp structure is fully tightened, the surfaces of cutout portions in the two clamping blocks each closely conform to and uniformly engage a lateral half of the rail periphery and laterally clamp the rail laminae together with a clamping force which is very evenly distributed along the nonplanar opposite lateral side surfaces of the clamped rail section, thereby essentially eliminating marring and deformation of the rail caused by clamping force concentrations on circumferentially spaced portions thereof.

16 Claims, 2 Drawing Sheets

APPARATUS AND ASSOCIATED METHODS FOR FORMING CURVED WOODEN HAND RAILS FOR SPIRAL STAIRCASES AND THE LIKE

BACKGROUND OF THE INVENTION

The present invention relates generally to the fabrication and installation of wooden hand rails for freeform staircases, such as spiral staircases, and more particularly relates to improved clamping methods and apparatus for fabricating and installing curved, laminated wooden staircase hand rails.

As is well known in the construction industry, the fabrication and installation of curved, laminated wooden hand rails on curving staircase structures is a cumbersome, time-consuming and rather difficult task which must be carefully performed in order to provide an acceptable installed hand rail product. The typical spiral staircase hand rail is formed from an elongated, laminated wooden structure commonly referred to as a "bending rail" which is defined by a laterally abutting series of relatively thin flexible wooden laminae which are glued together to form the hand rail which typically is provided with an ornately configured cross-section along its length, the decorative cross-section usually having lateral projections and indentations along its length.

To form the wooden bending rail, a suitable wood glue is applied to the facing vertical side surfaces of the individual laminae, and the laminae are then hand-pressed and held together until the initially assembled bending rail is clamped to temporary vertical support members secured to each individual stair step on the stair case. Since conventional bending rails are quite long-typically in the range of from about 16 feet to about 30 feet—it normally takes four or five workers to manually hold spaced apart longitudinal sections of the bending rail together until the rail is temporarily clamped to these vertical support members. The four or five workers typically carry the bending rail up the staircase, while still holding the individual rail laminae together, and a central longitudinal portion of the rail is clamped to one of the vertical support members. The rail is then bent into place and successively clamped (toward its opposite ends) to additional temporary vertical support members.

Additional intermediate clamps are then installed on the bending rail, between each of the vertical support members, and the glue between the rail laminae is allowed to dry. When the glue has dried, the temporary clamps are removed, and the bending rail is permanently secured to balusters later installed on the staircase.

In addition to being a decidedly awkward task, this conventional installation of wooden bending rails is less than satisfactory from a variety of other standpoints. For example, the temporary clamping of longitudinally spaced apart sections of the bending rail is conventionally accomplished using ordinary metal C-clamps which force small wooden blocks against opposite, laterally outwardly projecting side surface portions of the rail. This causes undesirable lateral stress concentrations on the outwardly projecting opposite side portions of the rail, tending to indent and mar them. Accordingly, when the temporary clamps are removed, a great deal of work is often required to smooth over these marred areas.

Additionally, to inhibit relative vertical shifting between the individual rail laminae, it has heretofore been necessary to form complementary ribs and grooves on the vertical side surfaces of the laminae which are adapted to interlock and hold the upper and lower side surfaces of the rail in precise alignment while the laminae are being manually pressed together by the various workers as the rail is being carried up the staircase and being temporarily clamped to the vertical support members. The necessity of forming these interlocking ribs and grooves on the individual bending rail laminae significantly increases the fabrication cost of the bending rail. Moreover, it is necessary that these interlocking ribs and grooves be very precisely located on the individual laminae to avoid undesirable irregularities in the top and bottom side surfaces of the bending rail. If these ribs and grooves are not very precisely located, it is necessary to subsequently expend considerable effort to smooth out the top and bottom side surfaces of the finished bending rail.

From the foregoing it can be readily seen that improved clamping apparatus and methods for forming and installing bending rails of this general type would be highly desirable. It is accordingly an object of the present invention to provide such improved apparatus and methods.

SUMMARY OF THE INVENTION

In carrying out principles of the present invention, in accordance with a preferred embodiment thereof, specially designed, contoured clamping structures are provided which essentially eliminate the conventional problems, limitations and disadvantages associated with the conventional construction and installation of curved, laminated wooden bending rails. Each of the clamping structures comprises two relatively thin, complementary clamping block sections having upper and lower end portions and facing side edge surfaces. Formed inwardly into the facing side edge surfaces, and spaced inwardly from the top and bottom end portions of the clamping blocks, are cutout areas whose peripheries each precisely correspond to a lateral half of the exterior periphery of the bending rail.

In use, the clamping blocks of each of the clamping structures are positioned on opposite sides of a selected longitudinal section of the bending rail and are intersecured at their upper and lower end portions by a tightening bolt structure. By appropriate tightening the bolt structures, the clamping block members are moved laterally toward one another until upper and lower end portions of their facing side edge surfaces are brought into contact. At this point, the surfaces of the cutout areas in the clamping blocks uniformly engage the exterior surface of the bending rail, at the clamped location, around its entire periphery. Facing, generally vertical portions of the cutout areas uniformly contact the opposite side contours of the bending rail and exert thereon a vary uniformly distributed horizontal clamping force on the individual rail laminae to thereby essentially eliminate clamping stress concentration forces which would otherwise mar the laterally outwardly projecting portions of the opposite rail side surfaces.

Additionally, facing upper and lower portions of the complementary clamping block cutout surfaces conform precisely to the contours of the upper and lower side surfaces of the rail to positively prevent relative vertical shifting between the individual rail laminae. This advantageously eliminates the necessity of forming the previously mentioned interlocking ribs and grooves on the vertical side surfaces of the laminae, thereby reducing the cost of fabricating the laminae and very positively aligning their upper and lower exterior surfaces.

The use of the contoured clamping structures of the present invention also greatly facilitates the installation of the bending rail by more positively holding the individual laminae in place until the wood glue therebetween dries. During the initial fabrication of the bending rail, using its non-interlocking laminae, the glue is placed on the vertically facing side surfaces of the laminae and a series of the clamping structures of the present invention (each in a partially loosened condition) are simply slid onto the bending rail and positioned at predetermined longitudinally spaced locations thereon, and then partially tightened. This permits the initially constructed bending rail to be carried up the staircase by considerably fewer workers since the contoured clamping members eliminate the necessity of many hands to temporarily hold the bending rail laminae in place.

During the installation of the bending rail on the temporary vertical support members on the staircase, a central longitudinally clamping structure is firmly tightened, and then an ordinary C-clamp is used to secure the tightened central clamping member to a central vertical support member. Successive contoured clamping members adjacent the other vertical support members are then tightened and clamped to the support members. Finally, the contoured clamping members disposed between the vertical support members are fully tightened. After the glue dries, the contoured clamping members may be rapidly removed by simply sliding them off one of the rail ends, the bending rail secured to subsequently installed balusters, and the final finishing of the installed hand rail effected.

In a preferred embodiment thereof, the contoured clamping members of the present invention are of a relatively thin, generally plate-like configuration, and are formed from an ultra high molecular weight polyethylene material or other suitable "non-stick" synthetic material. This substantially prevents the clamp members from adhering to the wood glue which is squeezed out of the spaces between laminae at the top and bottom sides of the bending rail when the clamps are tightened. The upper and lower side surfaces of the complementary cutout areas in each clamping member, due to their uniform contact with the upper and lower side surfaces of the bending rail, also inhibit glue outflow directly onto the clamp surfaces. This permits the glue (which is typically a water soluble glue) to be "washed" away from the bending rail, before the glue dries, without the necessity of moving any of the contoured clamps. This greatly reduces the amount of finish sanding required to complete the curved hand rail installation.

The contoured clamps of the present invention are very easy to use, are quite durable, and are relatively inexpensive to fabricate. The use of the contoured clamps, as described above, significantly reduces the overall time and expense required to form and install the bending rail, and provides a higher quality hand rail end product with little or any marring of the rail due to the uniform clamping force distribution achieved by the clamping members.

DETAILED DESCRIPTION

Figure 1:
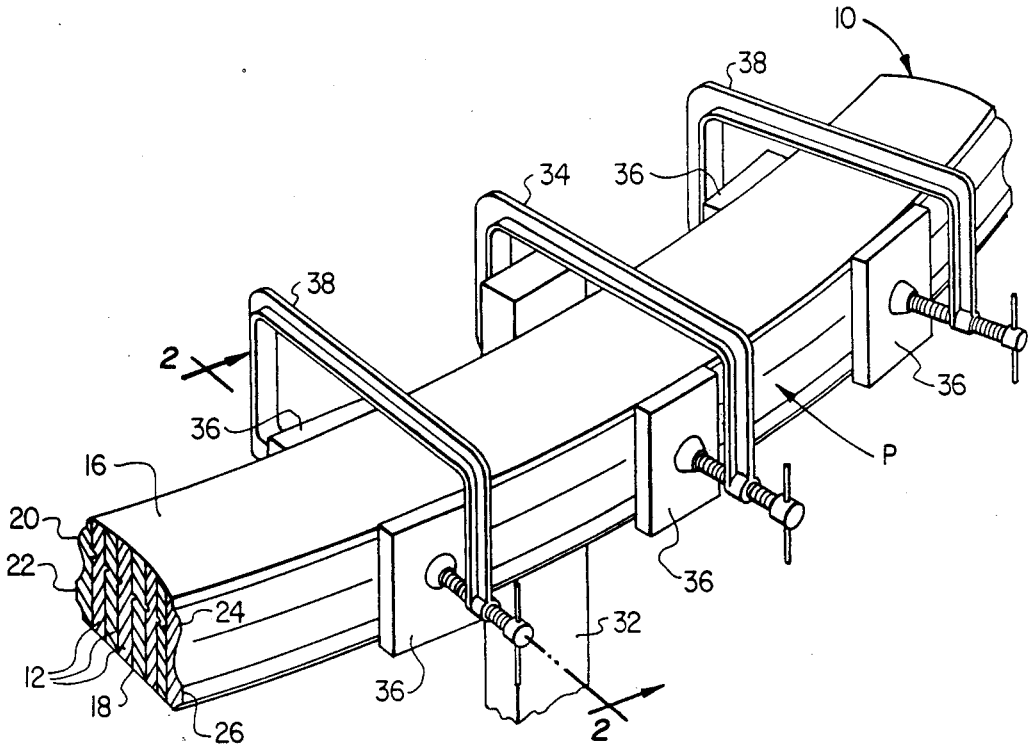
FIG. 1(PRIOR ART)
FIG. 1 (Prior Art) is a perspective view of a central longitudinal portion of a curved, laminated wooden spiral staircase hand rail being formed using conventional clamping methods.
Figure 2:
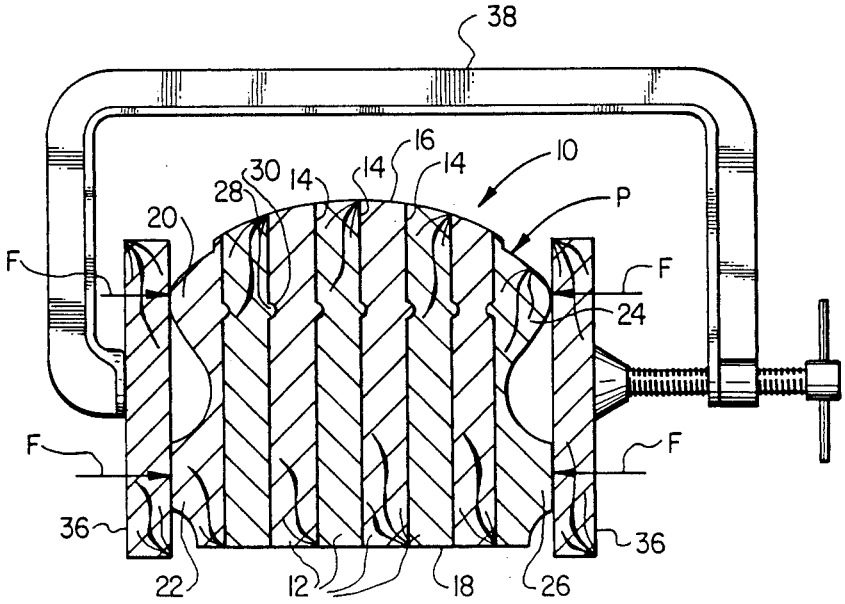
FIG. 2 (PRIOR ART)
FIG. 2 (Prior Art) is an enlarged scale cross-sectional view through the hand rail portion, partially in elevation, taken along line 2—2 of FIG. 1.

The conventional fabrication of a curved wooden hand rail, for installation on a spiral staircase or the like (not shown), is illustrated in FIGS. 1 and 2, the hand rail being formed from an elongated wooden structure commonly referred to as a "bending rail" 10 which may range in length from approximately 16 feet to approximately 30 feet. As best illustrated in FIG. 2, the bending rail 10 is of a laminated construction defined by a series of elongated wooden laminae 12 which laterally abut one another and are intersecured by a suitable wood glue 14 positioned between the abutting, vertically extending side surfaces of the laminae.

As is customary with decorative hand rails of this type, the bending rail 10 is provided with an ornately configured cross-sectional periphery P including, for example, a top side surface area 16, a bottom side surface area 18, a left side surface area having laterally outwardly projecting portions 20 and 22, and a right side surface area having laterally outwardly projecting portions 24 and 26. To inhibit relative vertical shifting between the laminae 12 during the subsequently described initial handling and bending of the rail 10, complementary longitudinally extending ribs and grooves 28, 30 are formed on the abutting side surfaces of the laminae 12 to provide a mechanical interlock between each adjacent laminae pair.

To initially assemble the conventional bending rail 10, the glue 14 is applied to the facing vertical side surfaces of the laminae 12, and the laminae are manually pressed together and held in place by as many as four or five workers, depending upon the overall length of the bending rail. The rail is then carried up the staircase and, with the workers still holding the laminae 12 together, a central portion of the bending rail 10 is clamped to a temporary vertical support member 32 secured to one of the stairs. This temporary clamping of the rail 10 to the vertical support member 32 is effected using a conventional metal C-clamp member 34 which bears at one end against the support member 32, and at its other end against a small wooden block member 36 pressed against the right side projections 24, 26 of the bending rail. With the workers still holding the rail 10, and manually pressing its laminae 12 together, successive longitudinal sections of the rail are clamped to additional temporary vertical support members spaced along the length of the staircase. After the bending rail is clamped to these temporary vertical support members, additional metal C-clamps 38, and protective wooden blocks 36, are used to temporarily clamp spaced apart sections of the bending rail between each adjacent pair of the vertical support members 32.

As can be imagined, the necessity of using four of five workers, each holding the bending rail 10 and manually pressing its laminae 12 together while carrying the rail up a spiral staircase, is an awkward and often difficult task. Additionally, the installation of all of the C-clamps 34 and 38 is a time-consuming endeavor. Further, the use of the metal C-clamps and the wood blocks 36 (which typically must be cut at the jobsite) tends to undesirably mar the bending rail 10 to an extent requiring a great deal of restorative finishing of the rail after the glue 14 has dried and the C-clamps have been removed.

Specifically, as best illustrated in FIG. 2, the use of the metal C-clamps, such as clamp 38, and its associated wood blocks 36, creates horizontal clamping force concentrations F which are borne by the horizontally outwardly portions 20, 22, 24 and 26 of the bending rail. These clamping force concentrations tend to permanently indent these outwardly projecting side portions of the bending rail. However, the total clamping force which produces these spaced apart force concentrations must be sufficiently high to assure that the individual laminae 12 are tightly pressed one another until the glue 14 dries. Even with this high clamping force, though, the critical cross-sectional areas of the bending rail (i.e., the upper and lower ends of the laminae joints) tend to receive a lesser amount of effective clamping force than at the force concentration zones.

Figure 3:
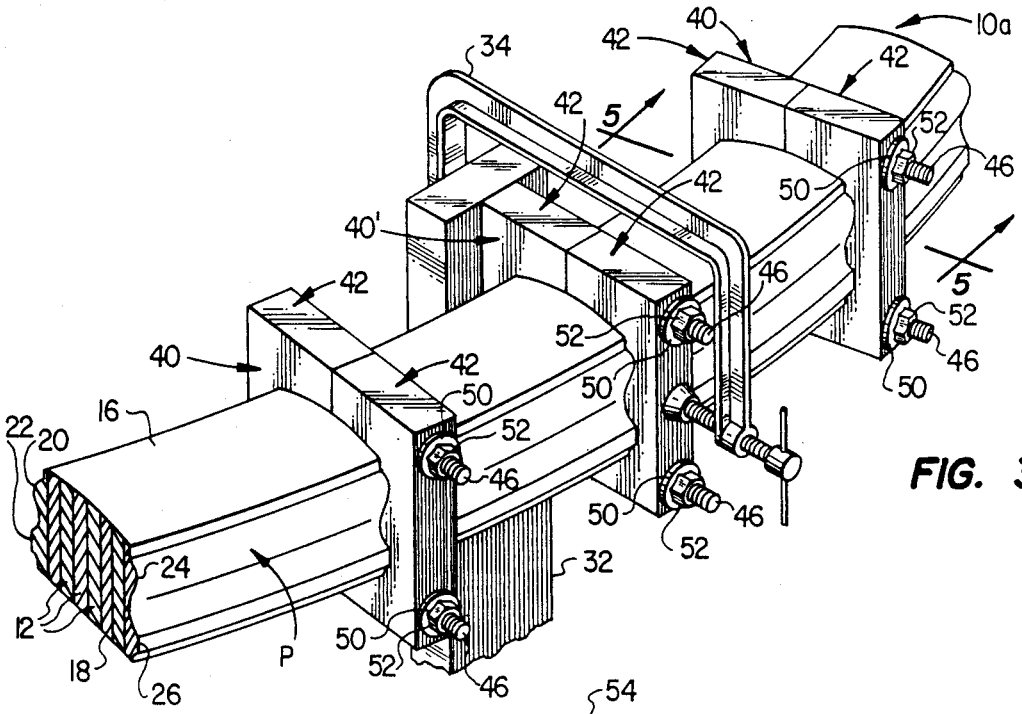
FIG. 3 is a perspective view of a central longitudinal portion of a curved, laminated spiral staircase hand rail being formed utilizing a significantly improved clamping method which embodies principles of the present invention.
Figure 4:
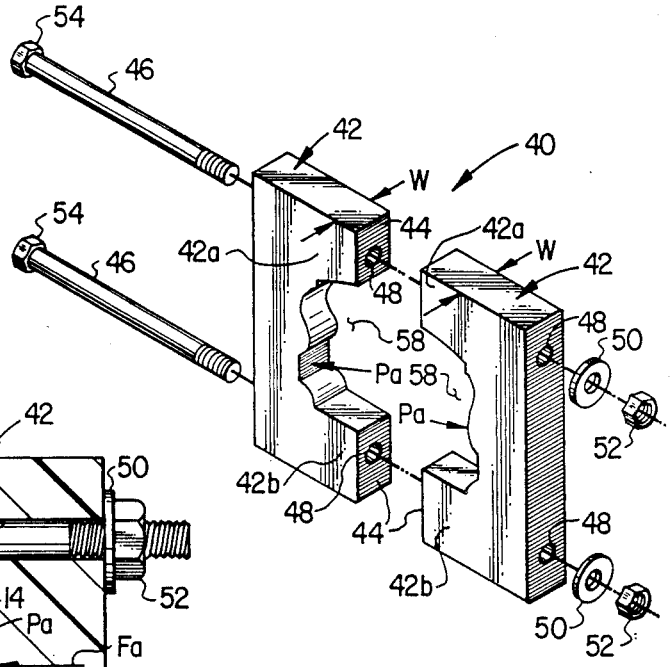
FIG. 4 is and enlarged scale exploded perspective view of one of the contoured clamping structures illustrated in FIG. 3.
Figure 5:
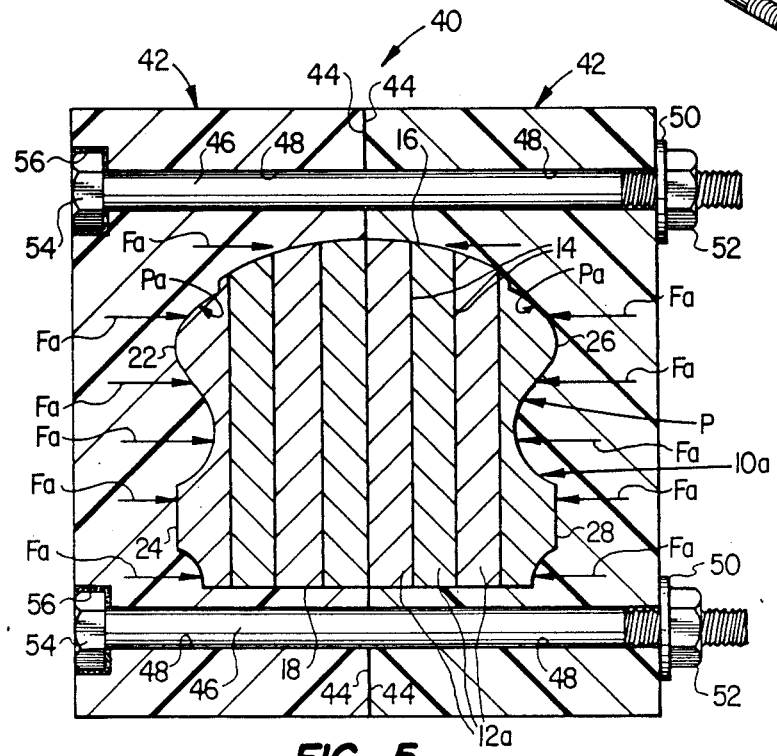
FIG. 5 is an enlarged scale cross-sectional view, partially in elevation, through one of the contoured clamping structures taken along line 5—5 of FIG. 3.

These and other problems, limitations and disadvantages associated with the conventional clamping methods apparatus used to form and install the bending rail 10 are essentially eliminated in the present invention by its unique provision of specially designed, contoured clamping structures 40 which are illustrated in FIGS. 3–5. For purposes of comparison, the clamping structures 40 are illustrated as being used in conjunction with a laminated wooden bending rail $10_a$ which has an exterior cross-sectional periphery or contour P identical to that in the previously described bending rail 10. However, and quite importantly, the laminae $12_a$ in the bending rail $10_a$ are not provided with the ribs and grooves 28, 30 of the rail 10 which mechanically interlock the laminae to inhibit relative vertical shifting thereof. As will be seen, the unique configuration and operation of the clamping structures 40 eliminate the necessity for this mechanical interlock between the individual rail laminae, thereby significantly reducing the fabrication cost of the laminae $12_a$, and thus the bending rail $10_a$.

Each of the contoured clamping structures 40 comprises a pair of clamping block members 42 which are preferably formed from an ultra high molecular weight polyethylene material (or other synthetic, essentially "non-stick" material) and have relative narrow widths W. The clamping blocks 42 in each pair thereof have upper and lower end portions $42_a$ $42_b$ with facing side surfaces 44 which may be drawn into firm abutment by a pair of bolt members 46 extending through a pair of bolt holes 48 formed in the upper clamp member end portions $42_a$ $42_b$ and secured to appropriate washers and nuts 50, 52 at their right ends. The hexagonal bolt heads 54 are press-fitted into circular counterboards 56 formed in the upper and lower end portions of the left clamping block member, and are epoxied in place within the counterbores.

Formed in the facing inner side edges of the clamping blocks 42, between their upper and lower end portions $42_a$ and $42_b$, are a pair of indentations 58, each having a surface contour $P_a$ essentially identical to a horizontal half of the external cross-sectional periphery P of the bending rail $10_a$.

Accordingly, with the nuts 52 slightly loosened to permit separation of the facing clamping block member side surfaces 44, each clamping structure 40 may be slid onto the bending rail $10_a$, from one of its ends, moved to a selected longitudinal portion bending rail $10_a$, and then firmly tightened onto the rail by re-tightening the two nuts 52. As best illustrated in FIG. 5, this tightening of the clamping structure 40 onto the rail $10_a$ draws the clamping block surfaces 44 into firm abutment and causes the contoured cutout surfaces $P_a$ to conform to and uniformly engage horizontal halves of the exterior cross-sectional periphery P of the rail $10_a$. Stated otherwise, when the clamping blocks 42 of each clamp structure 40 are tightened into abutment around the bending rail $10_a$, the two contoured cutout surfaces $P_a$ collectively define a surface which clampingly engages the exterior cross-sectional periphery $P_b$ of the bending rail around its entire surface area circumscribed by the blocks 42.

As illustrated in FIG. 5, this very uniformly distributes the horizontal clamping force along the entire horizontally facing portion of the exterior periphery $P_a$ of rail $10_a$ as schematically depicted by the various distributed force arrows $F_a$. By simply comparing FIGS. 2 and 5, it can readily be seen that this eliminates the undesirable high clamping force concentrations on the laterally projecting portions 22, 24, 26 and 28 of the bending rail $10_a$, thereby essentially eliminating clamping force marring of the rail.

Additionally, and quite importantly, it can be seen that the upper and lower side portions of the contoured clamp member cutout surfaces $P_a$ cooperate to engage upper and lower side edge portions of the laminae $12_a$ to positively prevent relative vertical shifting between the laminae. This additional feature of the clamping structure 40 eliminates the previous necessity of forming a mechanical interlock (as by the ribs and grooves 28, 30 in FIG. 2) in the laminae $12_a$. In turn, this significantly reduces the fabrication cost of such laminae, and thus of the bending rail.

Referring now to FIG. 3, not only do the contoured clamping structures 40 of the present invention substantially eliminate the marring of the bending rail $10_a$, they also make the initial fabrication and subsequent installation of the rail considerably easier. In initially forming the bending rail $10_a$, glue 14 is applied to the facing side surfaces of the laminae $12_a$, and the laminae are brought into a side-by-side abutting relationship. A suitable number of the clamping structures 40, each in a partially loosened orientation, are then slid onto an end of the bending rail $10_a$ and moved along its length to their desired locations thereon. The clamp structures 40 are then tightened sufficiently to prevent relative vertical shifting between the various laminae, but not tight enough to prevent longitudinal slippage between the laminae which facilitates the bending of the rail $10_a$. With the clamping structures 40 in place in this manner, the bending rail $10_a$ is firmly held against undesirable laminae splaying during initial handling of the rail. The in-place clamping structures 40 also substantially reduce the number of workers required to carry the initially assembled bending rail up the staircase and temporarily secure it to the vertical support members 32. Simply stated, fewer hands are required to manipulate the rail $10_a$ since the clamping structures 40 operate to prevent relative vertical shifting and horizontal splaying of the laminae.

As illustrated in FIG. 3, a central clamping structure 40' is then fully tightened around the bending rail $10_a$ and is clamped to a central one of the temporary vertical support members 32 using a conventional C-clamp member 34 which bears against the support member 32 and an outer side edge portion of the clamping structure 40'. Moving toward its opposite ends, the bending rail 42 is bent into place adjacent successive ones of the additional temporary vertical support members 32, the clamping structures 40 adjacent to these additional support members are fully tightened, and the fully tightened successive clamping structures are in turn clamped to the vertical support members 32. Finally, the clamping structures 40 positioned between each adjacent pairs of the vertical support members 32 are fully tightened, and the glue along the entire length of the temporarily supported bending rail $10_a$ is allowed to dry.

Because of the unique configuration of the clamping structures 40 they may be vary rapidly tightened using a conventional power wrench. Coupled with the ease and rapidity with which the clamping structures may be installed on the bending rail $10_a$, it can readily be seen that the overall rail clamping process may be performed in considerably less time than is required using conventional C-clamps and field-cut wooden blocks along the entire length of the bending rail.

The clamping structures 40 also permit the glue 14 (typically a water soluble wood glue) to be washed off the top and bottom surfaces of the temporarily installed bending rail $10_a$ prior to the drying of the glue. This washing process is significantly facilitated by the compact configuration of the clamping structures 40 which permits the thorough washing of the top and bottom side surfaces of the bending rail between adjacent clamping structures without interference with the washing process by the structures themselves. Moreover, because each of the clamping structures firmly engages the upper and lower side surfaces of the bending rail $10_a$, glue does not tend to ooze out of the rail within the clamping structures. Coupled with the non-stick material used to form the clamping blocks 42, this essentially prevents the clamping blocks from becoming adhered to the bending rail. When the glue 14 has completely dried, the C-clamps 34 are removed, the clamping structure tightening nuts 52 are loosened, and all of the clamping structures are simply slid off the ends of the bending rail which may then be permanently secured to baluster members later secured to the staircase.

It will readily be appreciated that the clamping structures 40 may be effectively utilized in conjunction with bending rails having any desired cross-sectional configuration, whether symmetrical or nonsymmetrical. They are, of course, not limited to the representative cross-sectional contours of the illustrated bending rails 10 and $10_a$. The clamping structures 40 are very durable, may be inexpensively manufactured, are quick and easy to use, and may be adapted for any cross-sectional configuration of a particular bending rail simply by altering the contours of the clamping block cutout areas 58. The advantageous result of the use of the clamping structures 40 is that the resulting curved staircase hand rail is produced and installed at a substantially lower cost, and is of a substantially higher overall constructional quality since little, if any, work must be subsequently be done to restore bending rail surface portions marred during the clamping process.

The foregoing detailed description is to be clearly understood as being given by way of illustration and example only, the spirit and scope of the present invention being limited solely by the appended claims.

What is claimed is:

1. A clamp structure for clamping together, during gluing thereof, the laterally abutting laminae of an elongated bending rail or the like, the bending rail having an exterior contour defined by first and second opposite side surfaces extending between third and fourth opposite, generally laterally facing side surfaces, said clamp structure comprising:

first and second clamp members laterally inwardly movable, from opposite sides of the bending rail, to a tightened position, said first and second clamp members having surface means thereon which, with said first and second clamp members moved to their tightened position, uniformly engage and precisely conform to the exterior contour of a longitudinal section of the bending rail, around substantially its entire periphery, in a manner creating uniformly distributed lateral clamping forces along said third and fourth surface portions of the longitudinal section and engaging said first and second surface portions of the longitudinal section to prevent transverse relative sliding displacement between the adjacent pairs of laminae; and adjustable tightening means carried by said first and second clamp means and operative to controllably move them toward and away from said tightened position thereof.

2. The clamp structure of claim 1 wherein:

said surface means are defined by cutout areas formed in facing surfaces of said first and second clamp members, said cutout areas defining in each of said first and second clamp members a bending rail engagement surface closely conforming in contour to a lateral half of the exterior surface contour of the bending rail.

3. The clamp structure of claim 1 wherein:

said first and second clamp members are formed from a synthetic, non-stick material.

4. The clamp structure of claim 3 wherein:

said first and second clamp members are formed from an ultra high molecular weight polyethylene material.

5. The clamp structure of claim 1 wherein:

said adjustable tightening means include bolt means extending between said first and second clamp members, said bolt means being loosenable to permit said clamp structure to receive an end portion of the bending rail and then be slid along the bending rail to a clamping location thereon at which said bolt means may be tightened to bring the clamp members into operative clamping engagement with the bending rail.

6. A contoured clamp structure tightenable around a longitudinal section of an elongated, laminated wooden bending rail during the gluing together of its laminae, the longitudinal section of the bending rail having an exterior surface contour defined by opposite top and bottom exterior side surfaces extending between opposite, nonplanar lateral side surfaces, said contoured clamp structure comprising:

first and second clamp members having cutout portions therein with surface sections having contours substantially identical to the contours of said opposite, nonplanar lateral side surfaces of the longitudinal section of the bending rail, said first and second clamp members being laterally inwardly movable, from opposite sides of the longitudinal bending rail section, to a tightened position in which said surface sections engage and precisely conform to said nonplanar side surfaces of the longitudinal section and exert uniformly distributed lateral clamping forces therealong to thereby essentially prevent circumferentially spaced lateral clamping force concentrations on said lateral side surfaces which might otherwise deform and mar them; and adjustable tightening means, carried by said first and second clamp members, for controllably moving them toward and away said tightened position thereof.

7. The contoured clamp structure of claim 6 wherein:

each of said first and second clamp members has opposite end portions extending outwardly from its cutout portion, and said adjustable tightening means include a pair of tightening bolt members operatively interconnecting said end portions and permitting said clamp structure to be loosened sufficiently to be slid along the length of said bending rail before being tightened into operative clamping engagement therewith.

8. The contoured clamp structure of claim 6 wherein:

said first and second clamp members are formed from a synthetic non-stick material.

9. The contoured clamp structure of claim 8 wherein:

said first and second clamp members are formed from an ultra high molecular weight polyethylene material.

10. The contoured clamp structure of claim 6 wherein:

said first and second clamp members have generally plate-like configurations.

11. For use in constructing a laminated wooden bending rail having a cross-sectional peripheral surface defined by upper and lower portions and nonplanar opposite lateral side portions extending between said upper and lower portions, the bending rail being defined by abutting elongated wooden laminae which may be glued together along facing side surfaces thereof to form the bending rail, improved clamping apparatus for exerting a laterally directed clamping force on a longitudinal section of the bending rail to firmly hold the laminae in abutment with one another at and adjacent the longitudinal section, without appreciably marring the bending rail, while glue disposed between adjacent laminae pairs dries, said improved clamping apparatus comprising:

first and second clamp members laterally movable into abutment from opposite sides of the bending rail, said first and second clamp members having cutout area therein with surfaces substantially identical to lateral halves of said cross-sectional peripheral surface of the bending rail, said cutout areas being positioned on said first and second clamp members in a manner such that when said first and second clamp members are brought into abutment around the longitudinal bending rail section the surfaces of said cutout areas uniformly engage and conform to the exterior surface of the bending rail longitudinal section, around its entire periphery, create a lateral clamping force on the bending rail uniformly distributed along the opposite, nonplanar lateral side surface portions of the longitudinal section, and prevent relative vertical shifting of the laminae at the longitudinal section; and adjustable tightening means associated with said first and second clamp members and operative to selectively move them into and out of abutment with one another around the longitudinal section of the bending rail.

12. A method of constructing a curved staircase handrail comprising the steps of:

providing a series of elongated flexible laminae having laterally facing side surfaces;

applying an adhesive material to at least some of said side surfaces;

positioning said laminae in a laterally abutting relationship to form therefrom an elongated flexible bending rail having, along its length, an exterior surface contour defined by generally laterally facing opposite first and second side surfaces extending between third and fourth opposite side surfaces; and utilizing surfaces of opposed pairs of clamping members, positioned at longitudinally spaced sections of the bending rail, to conformingly engage and exert uniformly distributed, laterally directed clamping forces along longitudinally spaced sections of said first and second side surfaces, each clamping member pair additionally engaging longitudinal sections of said third and fourth side surfaces in a manner preventing relative shifting of the laminae in a direction parallel to the side surfaces thereof.

13. The method of claim 12 wherein the clamping members in each pair thereof are joined by tightening means for adjustably moving the two clamping members toward and away from one another, and each clamping member pair, in a partially loosened condition, may be slid onto and along the bending rail from an end thereof, and wherein said method further comprises the steps of:

adjusting the clamping member pairs to partially loosened orientations;

sliding the clamping member pairs onto the bending rail and positioning the clamping member pairs in a mutually spaced array on the bending rail;

partially tightening the clamping member pairs on the bending rail to facilitate transport thereof and preclude relative lateral sliding movement of the laminae, yet permitting relative longitudinal slippage of the laminae to facilitate bending of the rail;

carrying the bending rail up a curving staircase having vertical support members spaced along its length;

positioning a longitudinally intermediate clamping member pair adjacent a central one of the vertical support members;

tightening the longitudinally intermediate clamping member pair;

securing the tightened clamping member pair to the central support member;

bending the bending rail to position additional clamping member pairs adjacent the additional support members;

tightening the additional clamping member pairs; and securing the additional clamping member pairs to the additional support members.

14. The method of claim 13 further comprising the steps of:

permitting said adhesive material to set while said bending rail is secured to said support members;

disconnecting the clamping member pairs from said support members;

loosening said clamping member pairs; and sliding the loosened clamping member pairs off the bending rail.

15. The method of claim 14 wherein said adhesive material is a water soluble glue which is squeezed outwardly onto top and bottom side surfaces supported bending rail when the clamping members are tightened thereon, and wherein said method further comprises the step of:

washing the glue off the bending rail, while the tightened clamping member pairs are in place thereon, before the glue dries.

16. The method of claim 14 further comprising the steps of:

removing the support members;

installing baluster members on the staircase; and securing the bending rail to the balusters after the clamping member pairs have been removed from the bending rail.

* * * * *